US005716059A

United States Patent [19]

Thomas

[11] Patent Number: 5,716,059

[45] Date of Patent: Feb. 10, 1998

[54] BRAKE FOR AN IN-LINE ROLLER SKATER

[76] Inventor: Scott Thomas, 2085 Rawhide, Las Vegas, Nev. 89119

[21] Appl. No.: 607,423

[22] Filed: Feb. 28, 1996

[51] Int. Cl.[6] ..... A63C 17/14

[52] U.S. Cl. ..... 280/11.2

[58] Field of Search ..... 280/11.22, 11.23, 280/11.2, 11.27, 11.28, 11.19; 185/5, 6, 7

[56] References Cited

U.S. PATENT DOCUMENTS 4,966,377 10/1990 Yu ..... 280/11.22

5,183,276 2/1993 Pratt ..... 280/11.22

5,411,278 5/1995 Wittmann ..... 280/11.27

5,560,625 10/1996 Kuykendall ..... 280/11.2

*Primary Examiner*—Richard M. Camby

*Attorney, Agent, or Firm*—Quirk & Tratos

[57] ABSTRACT

A central part of a brake is a generally rectangular metal sheet with a rectangular notch in a top corner. A rectangular boot tab extends from the bottom of the central part, at right angles thereto, in a known direction. A rectangular braking tab extends from the top of the central part, at right angles thereto, in a direction opposite from the known direction.

7 Claims, 2 Drawing Sheets

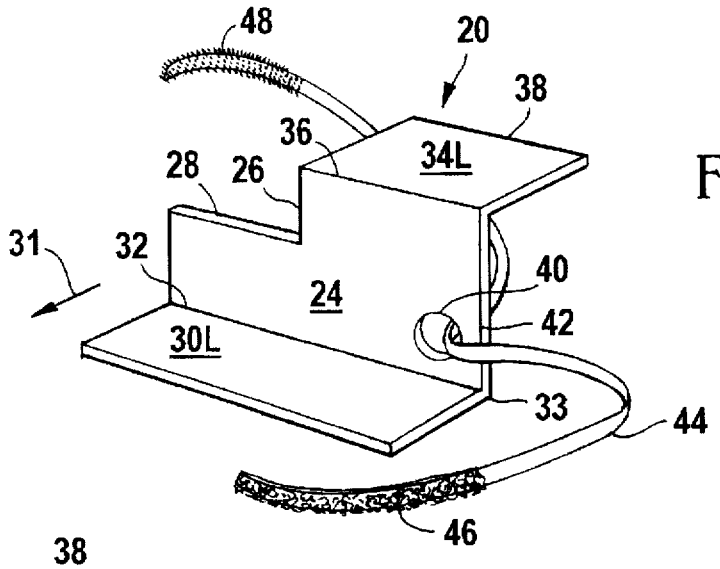
Fig. 2
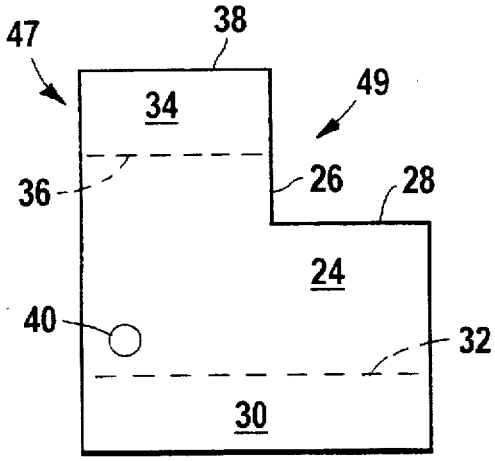
Fig. 3
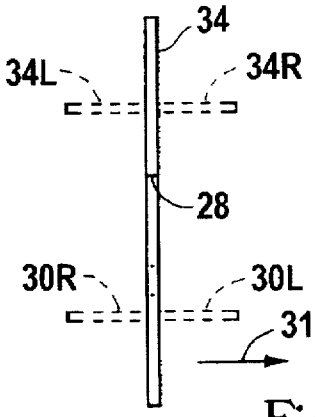
Fig. 4
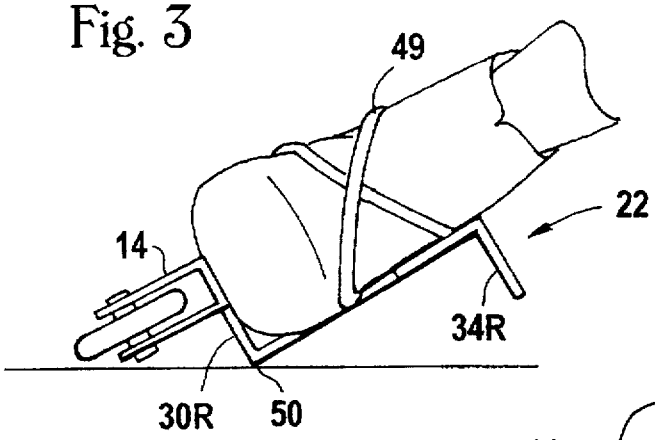
Fig. 5A
Fig. 5B
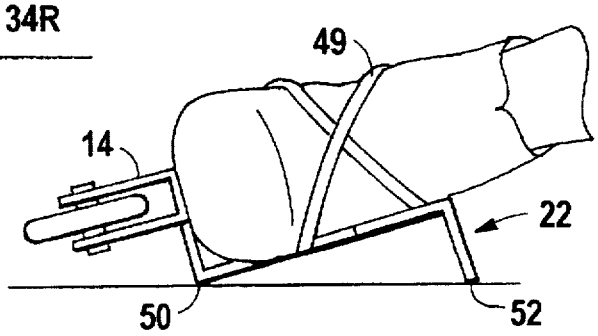

BRAKE FOR AN IN-LINE ROLLER SKATER

BACKGROUND OF THE INVENTION

1. Field of Invention

This invention is in the general field of in-line roller skating and, more particularly, is a brake for an in-line roller skater.

2. Description of the Prior Art

In-line roller skates typically have Neoprene™ wheels aligned like an ice skating blade. The principle of the in-line skate was initially conceived by the Olson brothers of Minneapolis, Minn. in the 1980's. The objective of the Olson brothers was to provide apparatus that could be used for training an ice hockey player when a skating rink is unavailable and for training a skier when a ski slope is unavailable. Modernly, in-line skating (often called roller blading) is recognized as a sport, independent of ice hockey and skiing.

It should be appreciated that an in-line skater can achieve speeds of over fifty miles per hour. At these speeds, it is desirable for the in-line skater to able to safely come to a stop without damage to the in-line skates.

When the in-line skater attempts to stop in a manner similar to the way that an ice skater stops, the result is often undue wear and misalignment of the wheels. When brakes are mounted on either the front or the rear of the in-line skates, skating up an incline may cause inadvertent braking.

When the front mounted brakes are applied, the in-line skater may be pitched forward thereby making it difficult to make the safe stop. Rear mounted brakes have been shown to be unsatisfactory at high speeds. Heretofore, there have not been brakes that are effective, are not inadvertently applied on an incline and can be consistently applied to make the safe stop.

SUMMARY OF THE INVENTION

An object of the present invention is to provide a brake that may be applied by an in-line skater to make a safe stop.

According to the present invention, a brake has a generally rectangular central part with a rectangular notch in a top corner. A rectangular boot tab is integrally connected to a bottom of the central part and extends therefrom in a known direction. A rectangular braking tab is integrally connected to a top of the central part and extends therefrom in a direction opposite to the known direction.

The present invention is a brake for an in-line skater that is not inadvertently applied on an incline and permits the in-line skater to travel at a high speed and make a safe stop.

Other objects, features, and advantages of the invention should be apparent from the following description of the preferred embodiment as illustrated in the accompanying drawing.

BRIEF DESCRIPTION OF THE DRAWING

FIG. 2 is a perspective view of a brake in the embodiment of FIG. 1;

FIG. 3 is a plan view of a sheet metal plate that is used to make a brake in the embodiment of FIG. 1;

FIG. 4 is a side elevation of FIG. 3;

FIG. 5A is a perspective view of the application of a brake of FIG. 1 during normal braking; and FIG. 5B is a perspective view of the application of a brake of FIG. 1 during full braking.

DESCRIPTION OF THE PREFERRED EMBODIMENT

Figure 1:
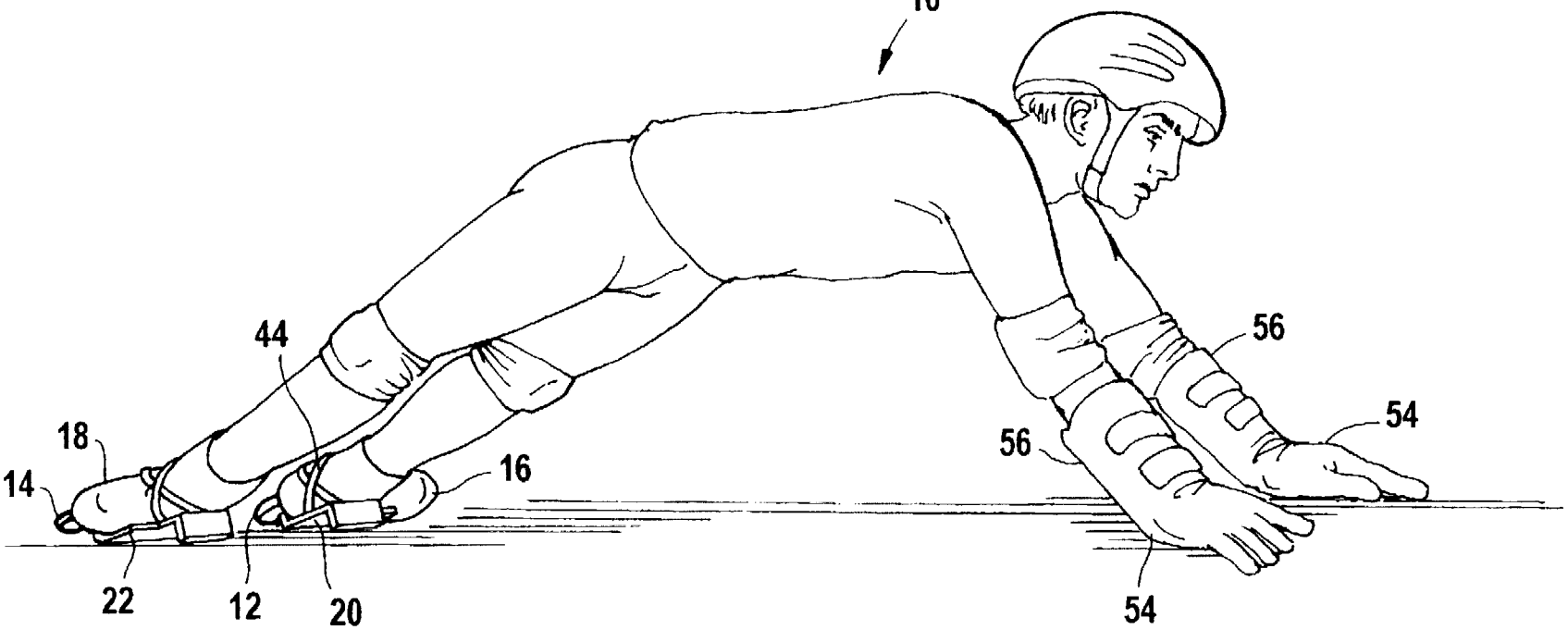
FIG. 1 is a perspective view of the preferred embodiment of the present invention.

The invention provides a brake that is useable by an in-line skater who may travel at high speeds along a roadway. Prior to the application of the brake, the skater turns in a manner similar to sliding into a softball base thereby causing his direction of motion to be rearward. Simultaneously, the in-line skater drops to what is called a laying it low position to apply brakes of the present invention.

As shown in FIG. 1, an in-line skater 10 has in-line wheel trucks 12, 14 that are respectively connected to boots 16, 18 of the skater 10. Additionally, brakes 20, 22, made from a material such as sheet metal, are respectively connected to the boots 16, 18.

In the laying it low position, the toes of the skater 10 are turned away from each other. Because the toes are turned, the trucks 12, 14, the boots 16, 18 and the brakes 20, 22 are each in a back-to-back alignment that is substantially perpendicular to the rearward direction of motion of the skater 10.

As shown in FIG. 2, the brake 20 includes a generally rectangular central part 24 with an L shaped notch in a top corner defined by edges 26, 28. A rectangular boot tab 30L of the brake 20 is integrally connected to a bottom edge of the central part 24 along a bend line 32. The tab 30L extends substantially at right angles to the central part 24 in the direction of an arrow 31. It should be understood that the tab 30L is in an abutting relationship with the sole of the boot 16 (FIG. 1).

A corner 33 is formed at a junction of the central part 24 and the tab 30L. As explained more fully hereinafter, the corner 33 abrades the roadway during normal braking. Additionally, a corner of the brake 22, corresponding to the corner 33, abrades the roadway during normal braking.

A rectangular braking tab 34L of the brake 20 is integrally connected to the top of the central part 24 along a bend line 36. The tab 34L extends substantially at right angles to the central part 24 in a direction, opposite from the direction of the arrow 31. The corner 33 and an edge 38 of the tab 34L concurrently abrade the roadway during full braking. Additionally, the corner and an edge of the brake 22, corresponding to the corner 33 and the edge 38, respectively, concurrently abrade the roadway during full braking.

The brake 20 additionally includes a hole 40 therethrough adjacent to the line 32 and an edge 42 of the central part 24. A fastening strip 44 with Velcro™ covered ends 46, 48, or any other suitable fasteners, passes through the hole 40. The strip 44 fastens the brake 20 to the boot 16 (FIG. 1).

As shown in FIG. 3, a generally rectangular sheet metal plate 47 has a rectangular L shaped notch 49 in a top corner. Near a bottom the plate 47, the central part 24 is integrally connected to a rectangular tab 30 along the line 32 (shown as a broken line). Similarly, near a top of the plate 47, the central part 24 is integrally connected to a rectangular tab 34 along the line 36 (shown as a broken line).

As shown in FIG. 4, when the tab 30 is bent to extend in the direction of the arrow 31 and the tab 34 is bent to extend in the direction opposite therefrom, the central part 24 with the tabs 30L, 34L are created, thereby forming the brake 20. Correspondingly, when the tab 34 is bent to extend in the direction of the arrow 31 and the tab 30 is bent to extend in the direction opposite therefrom, the central part 24 with a boot tab 30R and a braking tab 34R are created, thereby forming the brake 22.

As shown in FIG. 5A, the brake 22 is fastened to the boot 18 by a fastening strip 49 that is similar to the strip 44. During normal braking of the brake 22, a corner 50 (corresponding to the corner 33) abrades the roadway. Moreover, because of the width of the tab 30R, wheels of the truck 14 do not contact the roadway during the normal braking.

Correspondingly, wheels of the truck 12 do not contact the roadway during normal braking of the brake 20. Therefore, normal braking does not cause either wear or misalignment of the wheels of the trucks 12, 14.

As shown in FIG. 5B, during full braking of the brake 22, the corner 50 and an edge 52 (corresponding to the edge 38) concurrently abrade the roadway. As in normal braking, wheels of the truck 14 do not contact the roadway during full braking.

Correspondingly, wheels of the truck 12 do not contact the roadway during full braking of the brake 20. Therefore, full braking does not cause either wear or misalignment of the wheels of the truck 12, 14.

It should be understood that in the laying it low position, the rearward direction of motion causes the in-line skater's hands and wrists to be abraded by the roadway in the absence of safety equipment. Accordingly, in this embodiment the in-line skater wears gloves 54 (FIG. 1) and wrist guards 56 to prevent the abrasion of the hands and wrists.

While the invention has been particularly shown and described with reference to a preferred embodiment thereof, it should be understood by those skilled in the art that changes in form and detail may be made therein without departing from the spirit and scope of the invention.

I claim:

1. A brake adapted for connection to a boot of an in-line skater, comprising:

a generally rectangular central part that has an L shaped notch in a top corner;

a rectangular boot tab that is integrally connected to said central part at a bottom edge thereof, said boot tab extending substantially at right angles to said central part;

a rectangular braking tab that is integrally connected to said central part at a top edge thereof, said braking tab extending substantially at right angles to said central part, said boot tab and said braking tab extending in substantially opposite directions; and means for fastening said central part to said boot.

2. The brake of claim 2 wherein said central part has a hole therethrough and said foot tab is adapted to abut the sole of said boot, said means comprising a fastening strip that passes through said hole.

3. The brake of claim 2 wherein said strip includes Velcro™.

4. The brake of claim 1 wherein said central part and said tabs are made from sheet metal.

5. In the method of making a brake for an in-line skater that is applied on a roadway, the steps of:

providing a generally rectangular plate with an L shaped notch in a top corner;

bending a bottom end of said plate to create a boot tab that extends at substantially right angles to a central part of said plate; and bending a top end of said plate to create a braking tab that extends at substantially right angles to said central part, said top and bottom ends being bent to cause said tabs to substantially extend in opposite directions.

6. In the method of claim 5 wherein said step of providing includes providing a sheet metal plate.

7. In the method of claim 5 wherein said bending of said bottom end creates a boot tab that has a width that keeps a wheel of an in-line skate from contacting said roadway when said brake is applied.

* * * * *